US005595235A

United States Patent [19]

Anselm et al.

[11] Patent Number: 5,595,235

[45] Date of Patent: Jan. 21, 1997

[54] OUTBOARD MOTOR EXHAUST HOUSING AND LOST FOAM PATTERN THEREFOR

[75] Inventors: Michael C. Anselm, Fort Myers, Fla.; Clarence E. Blanchard, Kenosha, Wis.; James S. Nerstrom, Green Oaks, Ill.

[73] Assignee: Outboard Marine Corporation, Waukegan, Ill.

[21] Appl. No.: 552,396

[22] Filed: Nov. 3, 1995

Related U.S. Application Data

[62] Division of Ser. No. 255,096, Jun. 7, 1994, Pat. No. 5,498, 182.

[51] Int. Cl.[6] ..... B22C 7/02

[52] U.S. Cl. ..... 164/235; 164/34; 164/45; 164/246

[58] Field of Search ..... 164/235, 249, 164/45, 34

[56] References Cited

U.S. PATENT DOCUMENTS

| | | | |
|---|---|---|---|
| 4,507,090 | 3/1985 | Kobayashi et al. | 440/52 |
| 4,657,063 | 4/1987 | Morris | 164/45 |
| 4,861,295 | 8/1989 | McElroy, Jr. et al. | 440/86 |
| 5,031,685 | 7/1991 | Van Rens | 164/34 |
| 5,054,537 | 10/1991 | Van Rens | 164/34 |
| 5,121,787 | 6/1992 | Corbett | 164/34 |
| 5,161,177 | 12/1992 | Hubbell | 440/78 |
| 5,171,177 | 12/1992 | Hubbell | 440/78 |
| 5,372,176 | 12/1994 | Brown et al. | 164/249 |

*Primary Examiner*—Joseph J. Hail, III
*Assistant Examiner*—I.-H. Lin
*Attorney, Agent, or Firm*—Michael, Best & Friedrich

[57] ABSTRACT

Disclosed herein is a one piece drive shaft housing comprising a casting including an outer surface having an upper end surface, a lower end surface, and an endless side surface extending between the upper and lower end surfaces, an internal cavity extending between the upper and lower end surfaces and adapted to receive a drive shaft and a clutch operated linkage, an internal exhaust gas passage extending between the upper and lower end surfaces and located in spaced relation to the cavity, an internal coolant supply passage extending between the upper and lower end surfaces, an internal idle exhaust passage including a series of expansion chambers and extending between the upper end surface and the endless side surface, and an internal coolant drainage passage extending between the upper and lower end surfaces in heat exchanging relation to the exhaust gas passage.

6 Claims, 6 Drawing Sheets

31
421
49
411
11
45
35
47
49
33

31
411
312
11
47
45
35
43
33

31
49
13
312
35
43
14
47
11
14
41
49
33

OUTBOARD MOTOR EXHAUST HOUSING AND LOST FOAM PATTERN THEREFOR

This is a divisional of application Ser. No. 08/255,096, filed Jun. 7, 1994 and now issued as U.S. Pat. No. 5,498,182, entitled OUTBOARD MOTOR EXHAUST HOUSING AND LOST FOAM PATTERN THEREFOR.

BACKGROUND OF THE INVENTION

The invention relates generally to outboard motors and, more particularly, to drive shaft or exhaust housings incorporated in such outboard motors.

The invention also relates to lost foam castings and to multi-piece assemblies for casting outboard motor components.

Attention is directed to the following U.S. Pat. Nos.:

4,657,063 issued Apr. 14, 1987

5,031,685 issued Jul. 16, 1991

5,054,537 issued Oct. 8, 1991

SUMMARY OF THE INVENTION

The invention provides a lost foam pattern assembly comprising a port outer piece including a port outer side surface, and an inner surface defining a mating face, a port inner piece including an outer surface defining a mating face in engagement with the mating face of the inner surface of the port outer piece, and an inner surface defining a mating face and partially defining an exhaust gas passage, a starboard inner piece including an inner surface including a mating face in engagement with the mating face of the inner surface of the port inner piece and partially defining the exhaust gas passage, and an outer surface including a mating face, and a starboard outer piece including an inner surface defining a mating face in engagement with the mating face of the outer surface of the starboard inner piece, and a starboard outer side surface.

The invention also provides a lost foam pattern assembly having a front and comprising a port outer piece including a port outer side surface, and an inner surface including a mating face and partially defining a forward cavity and a coolant discharge passage, a port inner piece including an outer surface including a mating face in engagement with the mating face of the inner surface of the port outer piece and partially defining the coolant discharge passage, an inner surface including a mating face and partially defining an exhaust passage, and a wall extending between the mating faces of the port inner piece and partially defining the forward cavity which is located forwardly of the exhaust passage, a starboard inner piece including an inner surface including a mating face in engagement with the mating face of the inner surface of the inner piece and partially defining the exhaust gas passage and the cavity, an outer surface including a mating face and partially defining a coolant supply passage, and a wall extending between the mating faces of the starboard inner piece and partially defining the cavity, and a starboard outer piece including an inner surface including a mating face in engagement with the mating face of the outer surface of the starboard inner piece, and partially defining the coolant supply passage, and a starboard outer side surface.

Other features and advantages of the invention will become known by reference to the following general description and claims and the accompanying drawings.

THE DRAWINGS

Figure 3:
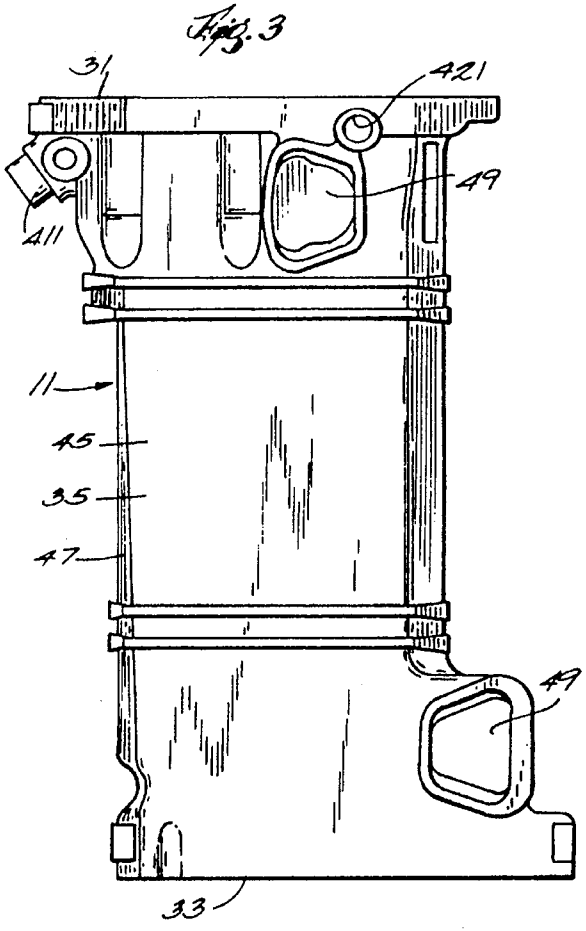
FIG. 3 is a starboard side elevational view of the exhaust housing and pattern assembly shown in FIG. 1.
Figure 2:
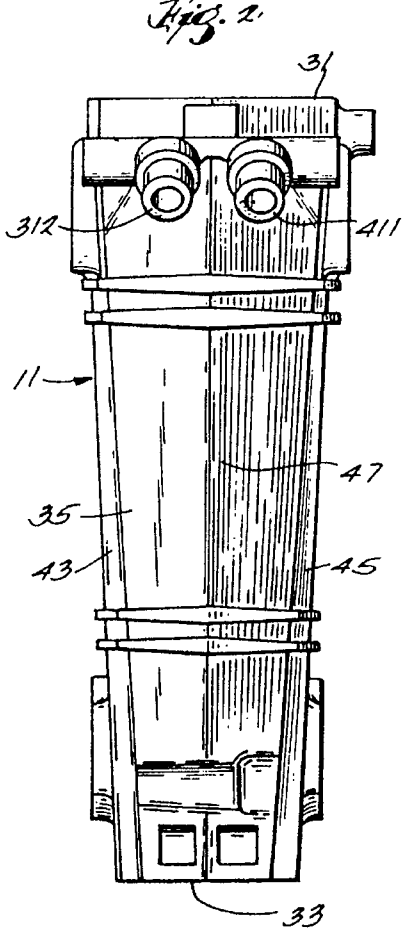
FIG. 2 is a rear elevational view of the exhaust housing and pattern assembly shown in FIG. 1.
Figure 1:
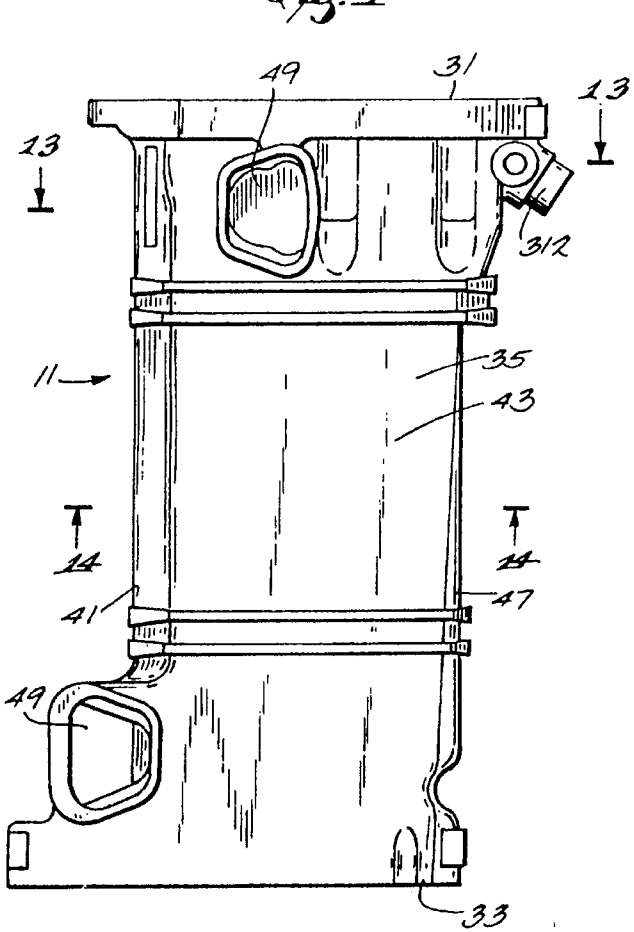
FIG. 1 is a side elevation view of an exhaust housing or drive shaft housing which is adapted for incorporation in an outboard motor and of a lost foam pattern assembly which is used to fabricate the exhaust housing, which housing and pattern assembly embody various of the features of the invention.

Before one embodiment of the invention is explained in detail, it is to be understood that the invention is not limited to the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

The drawings illustrate a one piece drive shaft housing or exhaust housing or casting 11 which is fabricated by the lost foam casting process from a lost foam pattern assembly 13 and which comprises a port outer side piece 21, a port inner piece 23, a starboard inner piece 25, and a starboard outer side piece 26.

The exhaust housing or casting 11 includes an upper end 31, a lower end 33, and between the upper and the lower ends, an endless outer side surface 35 including a front side surface or wall 41, a port side surface or wall 43, a starboard side surface or wall 45, and a rear side surface or wall 47. The outer side surface 35 is unbroken except for rubber mount apertures 49.

Extending between the upper and lower ends 31 and 33 and interiorly of the exhaust housing or casting 11 is an exhaust gas passage 51 including, at the upper end, an upper passage portion 53 adapted to communicate with an exhaust gas passage in the cylinder block through an opening 54, a central megaphone passage portion 55, and a lower enlarged expansion chamber portion 57 which communicates, at the lower end 33, through an opening or port 59.

Also included interiorly of the exhaust housing or casting 11 is a passage 61 for discharging coolant (water) from an engine cooling jacket (not shown). The coolant discharge passage 61 includes an upper portion 63 which, at the upper end 31, is adapted to communicate with a coolant discharge passage in the engine block through an opening 64, and which extends downwardly therefrom between a portion of the outer port side 43 and the upper and megaphone portions 53 and 55 of the exhaust gas passage 51. The coolant discharge passage 61 also includes a discharge opening 65 through which coolant is discharged into the lower enlarged expansion chamber portion 57 of the exhaust gas passage 51 and from which the coolant is discharged with the exhaust gas through the port 59 in the lower end 33 of the exhaust housing or casting 11.

The exhaust housing or casting 11 also includes a coolant (water) supply passage 71 which, at the upper end 31 of the exhaust housing or casting 11, is adapted to communcate with an engine coolant jacket supply port in an engine cylinder block (not shown) through an opening or port 72. The coolant supply passage 71 communicates, at the lower end 33 of the casting 11, with a cavity 73 which is adapted to accept a water pump (not shown). The exhaust housing or casting 11 also includes an idle relief passage 81 which communicates between the megaphone portion 55 of the exhaust gas passage 51 and the atmosphere and which will be described hereinafter in greater detail.

The exhaust housing or casting 11 also includes a forward cavity 85 which extends between the lower and upper ends 31 and 33, which includes portions adapted to lessen the weight of the exhaust housing or casting 11, and which is adapted to permit passage therethrough (in an associated assembled outboard motor) of a drive shaft (not shown) and of a transmission actuating linkage (not shown). At its lower end 33, the forward cavity 85 includes an enlarged portion which constitutes the cavity 73 which is adapted to receive the water pump (not shown) which, (in the associated assembly outboard motor) communicates with the coolant supply passage 71.

As already indicated, the exhaust housing or casting 11 is of one piece construction and is cast from the lost foam pattern assembly 13 which is adhesively assembled from port and starboard outer side pieces 21 and 27 and from the port and starboard inner pieces 23 and 25.

The port outer side piece 21 (see FIGS. 5 and 12) includes an outer side wall or surface 91 and partial front and rear walls or surfaces 93 and 95. The outer port side piece 21 also includes an inner surface 97 which includes a planar inside face 99 which mates with a mating face still to be described of the port inner piece 23.

The inside or mating face 99 extends from the front and rear outer walls or surfaces 93 and 95 and between the upper and lower ends 31 and 33 and includes portions forming the outer surface of a plurality of partitions or walls which will be described, which extend in upstanding relation from the outer side wall 91, and which form recesses in the inside mating face 99.

More particularly, the port outer side piece 21 includes a vertically extending wall 105 which defines a part of the mating face 99, and which, together with a lower part of the forward wall or surface 93, partially defines the expansion chamber portion 57 of the exhaust gas passage 51. The expansion chamber portion 57 is further defined by a horizontally extending wall 107 which also defines a part of the mating face 99. The horizontal wall 107 includes a recess 109 which partially defines the discharge outlet or opening 65 of the coolant (water) discharge passage 61.

The port outer side piece 21 also includes a wall 111 which extends vertically upwardly from the wall 107, which defines a part of the mating face 99, and which, together with an upper part of the forward wall or surface 93, also further defines the coolant (water) discharge passage 61. At its upper end, the coolant discharge passage 61 is further defined by short, generally horizontally extending, upper and lower walls 113 and 115, and by a short vertical wall 117 connecting the upper and lower horizontal walls 113 and 115. The upper horizontal wall 113 includes a port 119, see FIGS. 12 and 17, opening into (see FIG. 5) a recess 121 which is defined in the upper end or top surface 31 of the port outer side piece 21, and which forms the port or opening 64.

The vertically extending wall 105 also extends upwardly beyond the horizontal wall 107 and is joined to a horizontal wall 123 to partially define a weight saving portion 125 of the forward cavity 85.

Extending between the vertical walls 105 and 111 is a generally horizontal wall 131 which, together with the vertical walls 105 and 111, and the horizontal wall 107, partially define an upper idle relief expansion chamber 135 forming a part of the idle relief passage 81. Extending between the horizontal walls 115 and 131 is a short vertical wall 137 which, together with the vertical wall 111, and the horizontal walls 115 and 131, partially defines an upper idle relief expansion chamber 141. The upper and lower idle relief expansion chambers 135 and 141 communicate with each other through a notch or cut-out 143 in the horizontal wall 131. Located above the wall 131 and between the walls 105 and 137 is an end portion of a lower transverse conduit 193.

Located forwardly of the wall 117 is a recess forming an end portion of an upper transverse conduit 191 which communicates with a recess 145 which opens into the upper end 31 and forms another part of the idle relief passage 81.

Located in the upper end 31 and above and rearwardly of the wall 113 is a recess 147 forming a portion of the idle relief passages 81.

The port inner piece 23 includes a partial front outer wall or surface 151 and a partial rear outer wall or surface 153 (see FIG. 11), together with an outer mating face 155 which registers with the mating face 99 of the port outer side piece 21, and (see FIGS. 5 and 10) a center mating face 157 which registers with a center mating face which is still to be described and which forms a part of the starboard inner piece 25.

Figures 11, 12, 17, 18:
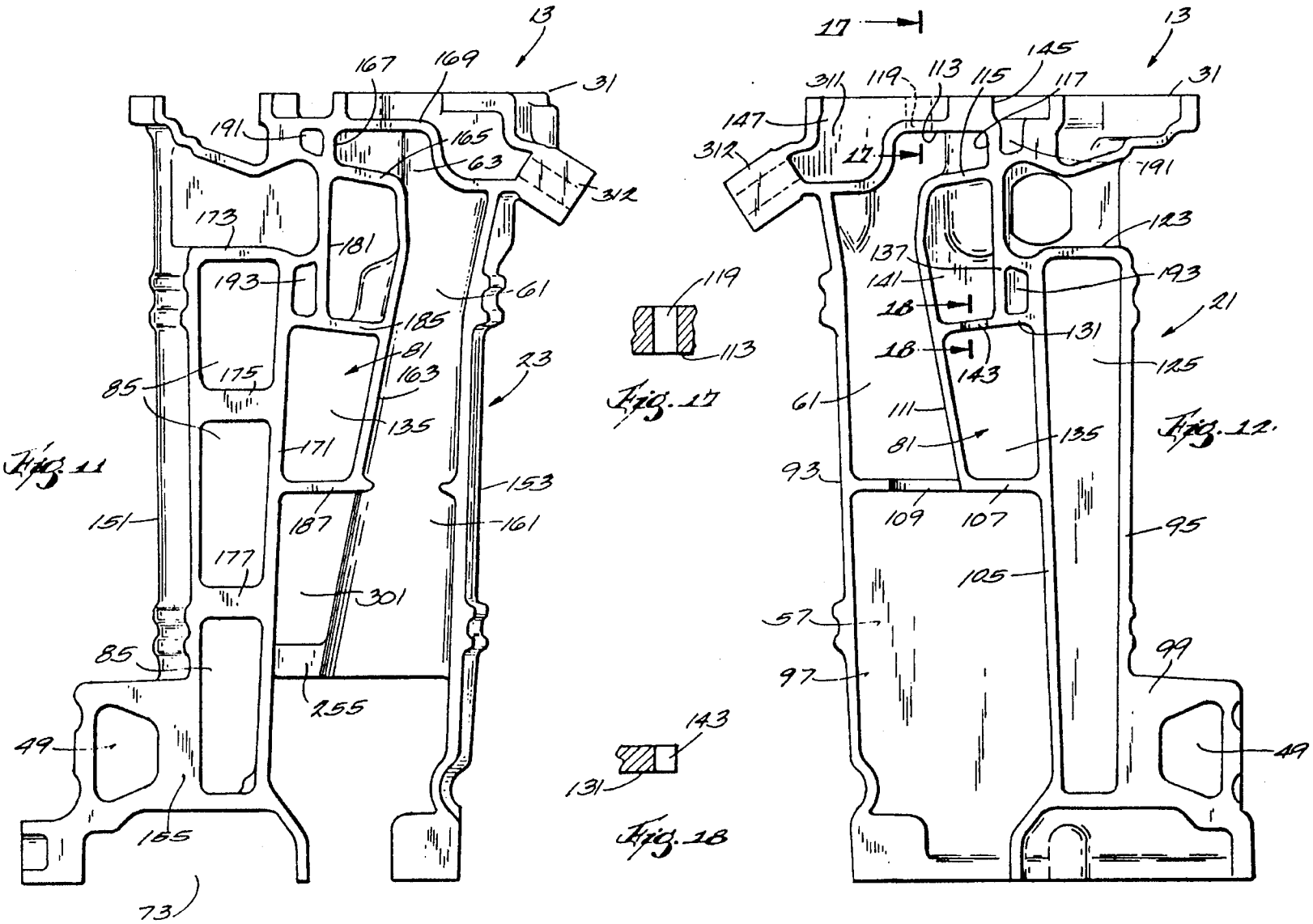
FIG. 11 is a side elevational view of the outside face of the port inner pattern piece forming a part of the lost foam pattern assembly shown in FIG. 1.
FIG. 12 is a side elevational view of the inside face of a port outer side pattern piece forming a part of the lost foam pattern assembly shwon in FIG. 1.
FIG. 17 is a fragmentary sectional view taken along line 17—17 of FIG. 12.
FIG. 18 is a fragmentary sectional view taken along line 18—18 of FIG. 12.

More particularly, as shown in FIG. 11, the port inner piece also includes a megaphone wall portion 161 which extends concavely arcuately from the partial rear wall or surface 153 and from the center mating face 157 and intermediate the mating faces 155 and 157. Adjacent the forward margin thereof, the megaphone wall portion 161 merges with a vertically extending wall 163 which is of full width, i.e., extends between the mating surfaces 155 and 157, and which registers with the wall 111 of the port outer side piece 21 to further define the coolant discharge passage 61. At its upper end, the vertical wall 163 merges with a horizontal wall 165 which, in turn, merges with a vertical wall 167 which merges with another horizontal wall 169. The walls 165, 167 and 169 respectively correspond to and are in registry with the walls 115, 117 and 113 of the outer port piece 21, and serve to further complete definition of the coolant discharge passage or cavity 61.

The port inner piece 23 also includes a vertical, full-width wall 171 which registers with the vertical wall 105 of the outer port side piece 21 to further define the forward cavity 85, and which is connected to the lower end of the megaphone wall portion 161 by a bridge 172. Horizontal wall segments 173, 175, and 177 connect the vertical wall 171 to the partial front wall or surface 151 to rigidify the pattern assembly 13 and the resulting casting 11.

The inner port piece 23 also includes a vertical, full-width wall 181 which registers with the wall 137 of the outer port piece 21 to further define the upper idle exhaust relief expansion chamber 141. The idle relief expansion chambers 135 and 141 are also further defined by a horizontal, full width, wall 185 which registers with the wall 131 of the port side outer piece 21 to separate the upper and lower idle relief expansion chambers 135 and 146.

The inner port piece 23 also includes a horizontal, full-width wall 187 which extends between the wall 163 and 171 and which forms the bottom wall of the lower idle relief expansion chamber 135. Extending between the mating faces 155 and 157 are the before mentioned upper and lower conduits or passages 191 and 193 which are formed by full width wall portions or partitions and which form part of the idle exhaust passage 81.

Viewed from the center mating surface 157, (see FIG. 10) the port inner piece 23, also includes a wall 201 which defines an idle exhaust gas passage portion 203 communicating between the upper portion of the megaphone passage portion 55 of the exhaust gas passage 51 and an adjacent corner of the upper expansion chamber 141 of the idle relief passage 81. In addition, the lower horizontal wall 187 includes a notch or cut-out 204, to provide a drain hole 205.

Figure 10:
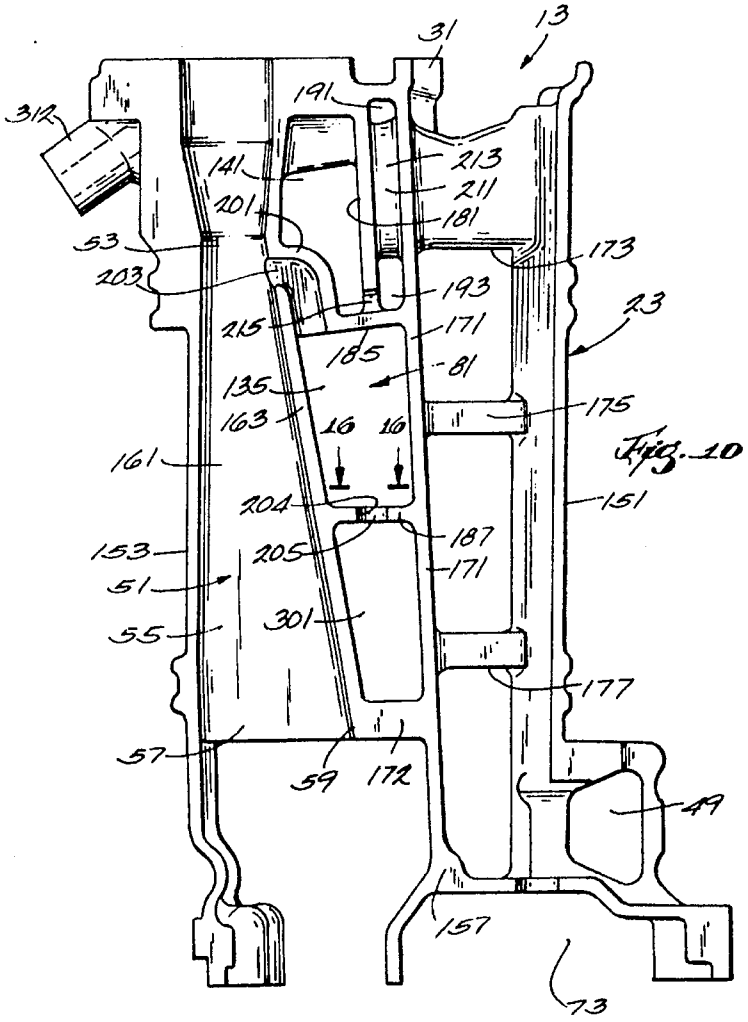
FIG. 10 is a side elevational view of the center face of a port inner pattern piece forming a part of the lost foam pattern assembly shown in FIG. 1.

Still further in addition, as shown in FIGS. 10 and 11, the port inner piece 23 includes an upper portion of the vertical wall 171, which portion is located in forwardly spaced relation from the vertical wall 181 and which, together with a fore and aft wall portion 211, defines an idle relief passage portion 213 which, at its upper end, communicates with the upper conduit 191 and which, at its lower end, communicates with the lower conduit 193 through a lateral cut-out or notch 215 at the lower end of the vertical wall 181 and with the bottom of the upper idle relief expansion chamber 141.

The convex side of the megaphone wall portion 161 is spaced inwardly of the outer mating face 155 to partially define a space 301 surrounding the lower end of the megaphone passage portion 55.

The starboard inner pattern piece 25 includes partial front and rear outer walls or surfaces 231 and 233, as well as a center mating face 235 which registers with the center mating face 157 of the port inner piece 23. In addition, the starboard inner pattern piece 25 includes an outer mating face 237 which registers with a mating face still to be described of the starboard outer side pattern piece 27.

When viewed from the center mating face, (see FIG. 9) the starboard inner piece 25 includes a concavely arcuate megaphone wall portion 241 which extends from the center face 235 and from adjacent the partial front wall or surface 231 to a generally vertically extending, full-width wall 251 which registers with the full-width wall 163 of the port inner piece 23. The convex side of the megaphone wall portion 241 is spaced inwardly of the outer mating face 237 to further define the space 301.

The starboard inner piece 25 also includes a vertical, full-width wall 253 which registers with the full-width wall 171 in the port inner wall piece 23, which further defines the forward cavity 85, and which is connected to the bottom of the megaphone wall portion 241 by a bridge 255 registering with the bridge 172 of the port inner piece 23.

The starboard inner piece 25 also includes horizontal, full-width upper and lower horizontal walls 261 and 263 which register with the walls 185 and 187 of the port inner piece 23 and which further define the lower idle relief expansion chamber 135. The wall 263 includes a small center cut-out 265 cooperating with the cut-out 204 in the wall 187 in the port inner piece 23 to define the drain hole 205.

The starboard inner piece 25 also includes a wall 271 which forms a recess and which mates with the wall 201 of the port inner piece 23 to complete formation of the idle relief passage portion 203 communicating between the upper end of the megaphone passage portion 55 and the upper rear corner of the upper idle relief expansion chamber 141.

Figure 9:
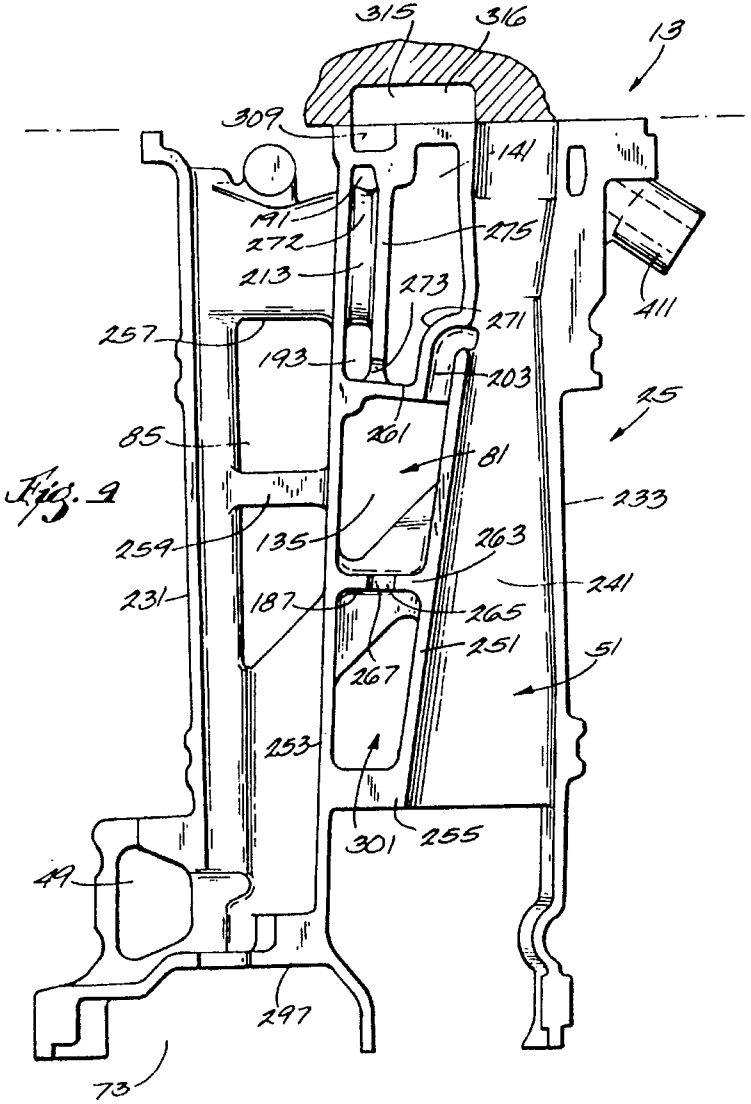
FIG. 9 is a side elevational view of the center face of the starboard inner pattern piece forming a part of the lost foam pattern assembly shown in FIG. 1.

In addition, as shown in FIG. 9, the starboard inner piece 25 also includes a vertical, full-width wall 275 which mates with the vertical wall 181 of the port inner piece 23, which further defines the upper idle relief expansion chamber 141, and which, together an upper portion of the wall 253, and a fore and aft wall 272, forms a recess completing the passage portion 213 connecting the upper and lower conduits 191 and 193. At its lower end, the passage portion 213 is connected to the bottom forward corner of the upper idle relief exhaust chamber 141 by a cut-out 273 cooperating with the cut-out 215 in the port inner piece 23.

Figure 15:
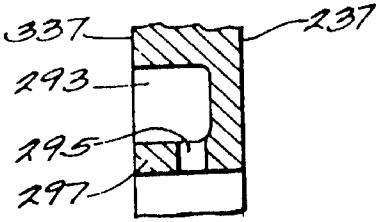
FIG. 15 is a fragmentary sectional view taken along line 15—15 of FIG. 8.

The starboard inner piece 25, as viewed from the outer mating face (see FIG. 8) includes a generally unbroken, enlarged, vertically extended portion 291 of the outer mating face 237, which portion 291, at its lower end, includes a blind aperture 293 which extends towards the center mating face 235 and which communicates (see FIG. 15) with a vertically extending aperture 295 communicating through a lower, horizontal, full-width wall 297 defining a part of the cavity 73 adapted to receive a water pump (not shown). The outlet (not shown) of the water pump is connected to the aperture 295 in the completed outboard motor.

Figure 8:
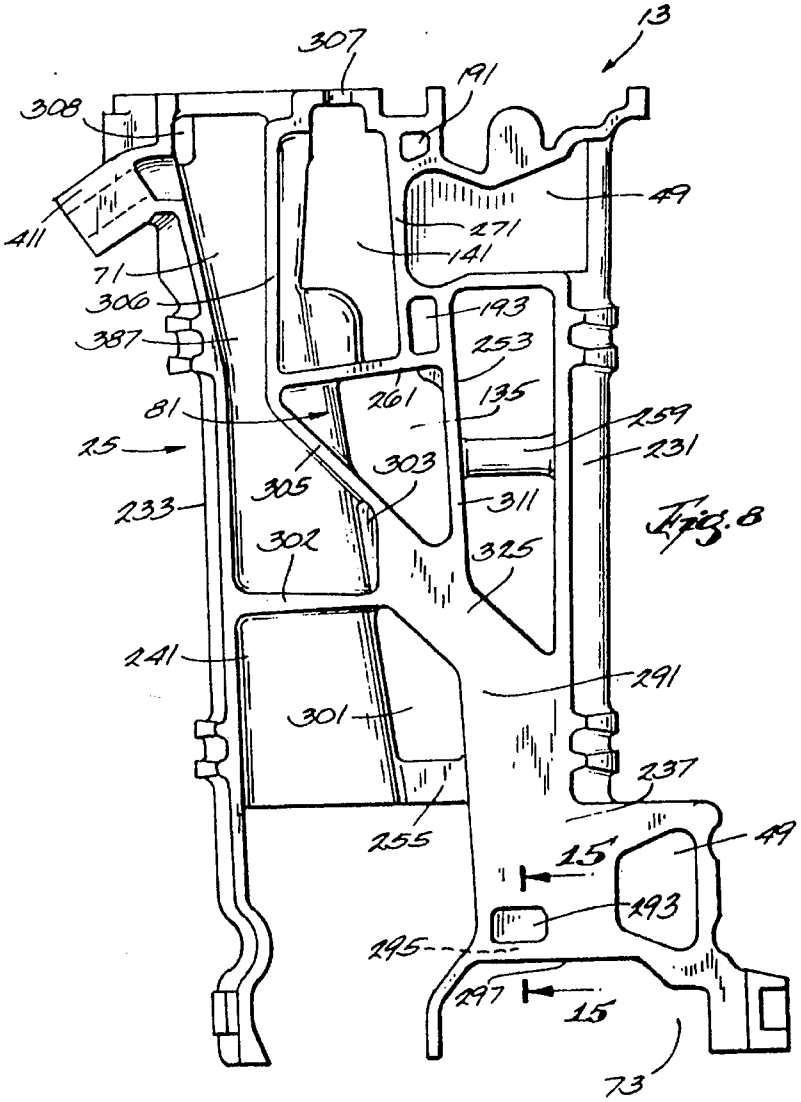
FIG. 8 is a side elevational view of the outer face of a starboard inner pattern piece forming a part of the lost foam pattern assembly shown in FIG. 1.

As shown in FIG. 8, the starboard inner side piece 25 also includes a horizontal wall 302 which extends in upstanding relation to the convex surface of the megaphone wall portion 241 and which extends from an upwardly and rearwardly inclined wall portion 325 of the mating face 291 to the front wall or surface 233.

In addition, as shown in FIG. 8, the starboard inner piece 25 also includes a vertical wall 303 extending in forwardly spaced relation from the forward wall or surface 233 and merging with the megaphone wall portion 241 and with the wall portion 311 of the outer mounting face 237. Still futher in addition, a wall 305 extends from the megaphone wall portion 241 and upwardly and rearwardly inclined relation from the wall 325 to further define the lower idle relief expansion chamber 135 and an upper portion 387 (see FIG. 7) of the coolant supply passage 71. At its upper end, the wall 305 merges with a vertical wall 306 which also extends in upstanding relation from the megaphone wall portion 241, and which also further defines the upper idle relief expansion chamber 141.

Also extending outwardly from the megaphone wall portion 241 and from the lower end of the wall 306 is a portion of the wall 261 extending between the lower and the upper idle relief expansion chambers 135 and 141.

At the upper end of the upper idle relief expansion chamber 141, the starboard inner piece 25 includes an opening 307 which affords, during the casting process, filling of sand into the upper idle relief expansion chamber, 141 and which is later plugged.

The volume defined between the upper part of the megaphone wall portion 241, the forward wall or surface 233, and the walls 302, 303, 305 and 306 constitutes a part of the upper portion 387 of the coolant supply passage 71 and is open in the upper end of the pattern assembly 13 to afford communication with a water supply in an engine block. The upper portion 387 of the coolant port supply passage 71 has an opening 308 into the center mating face 235, which opening 308 is closed when the inner pattern pieces 23 and 25 arc assembled into the pattern assembly 13.

When looking at the starboard inner piece 25 from the outer mating face 237, as shown in FIG. 8, the lower expansion chamber 135 of the idle relief passage 81 is reduced in size due to the rearwardly and upwardly inclined surface portion 325 in the plane of the outer mating face 237.

Figure 5:
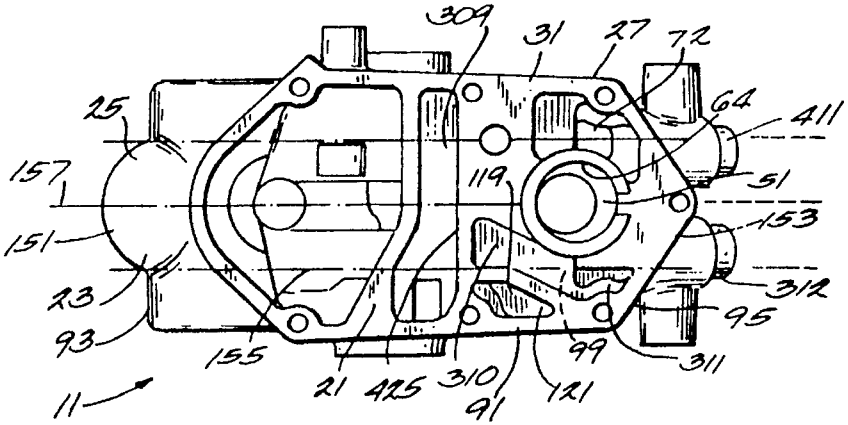
FIG. 5 is a top view of the exhaust housing and pattern assembly shown in FIG. 1.

The pattern assembly 13 includes at the upper end 31 thereof, see FIG. 5, a forward transverse recess 309 which is a part of the idle relief passage 81 and which is located immediately forwardly of the upper end of the forward cavity 85 and which is formed by recess portions 310 in each of the pattern pieces 21, 23, 25 and 27. In the outer pieces 21 and 27, the recess portions 310 have sufficient depth to communicate with the outer ends of the upper transverse conduit or passage 191.

Located immediately rearwardly of the forward transverse recess 309, in the upper end 31, is a second or rearward transverse recess 310 which is formed in the port outer side and inner pieces 21 and 23 and which includes a rearwardmost portion 311 (formed by the recess 147) extending around the opening 64 into the upper portion 53 of the exhaust gas passage 51. The rearwardmost portion 311 of the rearward recess 310 is of increased depth. Included in the port inner piece 23, adjacent the upper end 31, is a downwardly and rearwardly inclined outwardly projecting boss 312. In the finished exhaust housing 11, the boss 312 is bored to communicate the lower portion of the recess 310 with the atmosphere.

The idle relief exhaust gas passage 81 communicates between the forward and rearward transverse recesses 309 and 310 in the upper end 31 by reason of travel through a recess 315 which is located in the mating face of an attached engine block 316 and which straddles the recesses 309 and 310 as shown in FIG. 9. Thus, in operation with respect to exhaust travel during idle engine operation, the idle exhaust initially flows from the megaphone passage portion 55 through the passage portion 203 into the lower expansion chamber 135. The exhaust gas then flows through the cutouts 143 and 399 into the upper idle relief expansion chamber 141. From there, the idle releif exhaust gas flows through the cutouts 215 and 273 into the vertically extending recess 213 and into the upper and lower cross conduits 191 and 193. From the outer ends of the upper conduit 191, the idle relief exhaust gas flows into the forward transverse recess 309 in the upper end 31 and then through the recess 315 in the engine block 316, then into the rearward transverse recess 310, around the upper portion 53 of the exhaust gas passage 51 and into the lower end of the rearwardmost portion 311 of the recess 310 and out through the bore (subsequently machined) in the boss 312 to the atmosphere.

Figure 7:
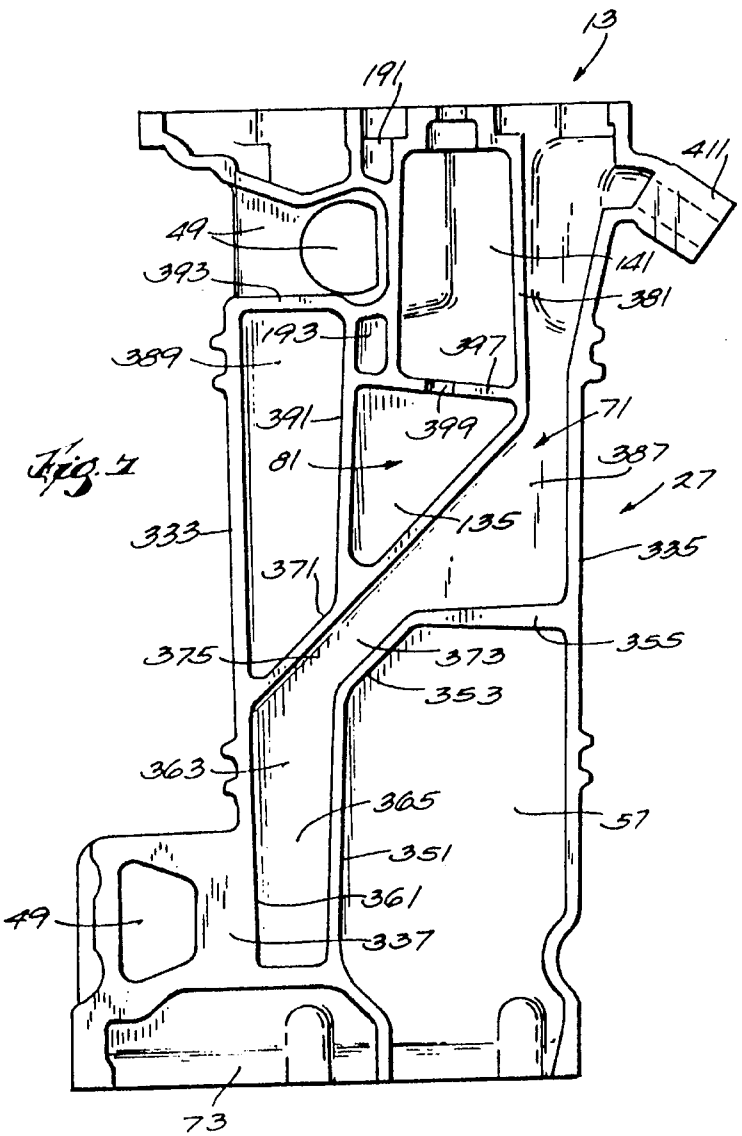
FIG. 7 is a side elevational view of the inside face of a starboard outer side pattern piece forming a part of the lost foam pattern assembly shown in FIG. 1.

As shown in FIG. 7, the starboard outer side piece 27 includes a starboard outer side wall or surface 325, a partial front wall or surface 333, and a partial rear wall or surface 335, together with a planar inner mating face 337 which registers with the outer mating face 237 of the starboard inner piece 25. As with the port outer side piece 21, the starboard outer side piece 27 includes various walls extending in upstanding relation from the outer side wall 311 and including (see FIG. 7) a first vertical wall 351 which mates with and engages the wall portion 291 of the starboard inner piece 25 and which merges with an upwardly and rearwardly inclined wall 353 which, in turn, mates with and engages the wall portion 325 of the starboard inner piece 25 and which, in turn, merges with a horizontal wall 355 extending to adjacent the partial rear surface 335 and mates with and engages the wall 302 of the starboard inner piece 25. The engagement of walls 351 and 353 with the portions 291 and 325 of the outer mating face 237 of the starboard inner piece and the engagement of the wall 355 with the wall 302 of the inner starboard piece 25, serves to further define the expansion chamber portion 57 of the exhaust gas passage 51.

To the left of the wall 351, as seen in FIG. 7, the starboard outer side piece 27 also includes a vertical wall 361 which, together with the vertical wall 351, defines a recess or cavity 363 which is located in the mating face 337 and which is covered by the wall portion 291 of the mating face 237 of the starboard inner piece 25 so as to define a lower portion 365 of the coolant supply passage 71 which communicates with the aperture 293 in the starboard inner piece 25.

Adjacent the upper end of the vertical wall 361, the starboard outer side piece 27 includes an upwardly and rearwardly inclined wall 371 which, together with wall 353, defines a recess 373 which is covered by the wall portion 325 of the outer mating face 237 of the starboard inner piece 25 to complete a central portion 375 of the coolant supply passage 71.

The upwardly and rearwardly inclined wall 371 merges into a vertically extending wall 381 which is located in spaced relation to the partial rear wall or surface 335. The walls 371 and 381 register with the walls 305 and 306 of the starboard inner piece 25, and further define, together with the parallel rear wall or surface 335, and the horizontal wall 355, the upper portion 387 of the coolant supply passage 71.

Another void or recess 389 forming a part of the forward cavity 85 is formed by the partial front wall or surface 333 of the starboard outer piece 27 and by a wall 391 which extends upwardly from the inclined wall 371 in alignment with the lower wall 351 and in registry with wall 253 of the starboard inner piece 25. The void 389 is completed by a horizontal wall 393 connected to the upper ends of the partial front wall or surface 333 and the vertical wall 391.

Extending between the vertical wall 381 and the lower end of the vertical wall 391 is a horizontal wall 397 which serves to further define the upper and lower idle relief expansion chambers 135 and 141. A cut-out 399 in the horizontal wall 397 provides a flow path between the upper and lower idle relief exhaust chambers 145 and 135.

As shown in FIGS. 7, 8, and 9, the starboard inner piece 25 and starboard outer piece 27 respectively include portions of a boss 411 which extends downwardly and rearwardly and which is subsequently bored (as shown in dotted outline) to communicate the atmosphere with the upper part 387 of the exhaust supply passage 71 so that a so called "telltale" is provided.

Figure 6:
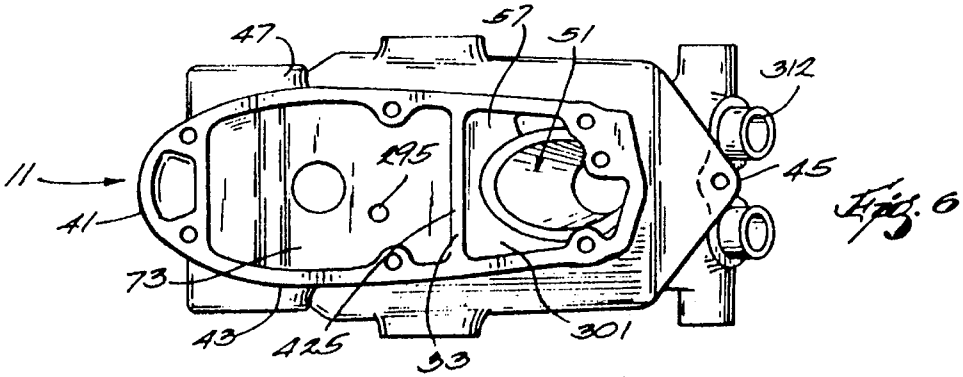
FIG. 6 is a bottom plan view of the exhaust housing and pattern assembly shown in FIG. 1.
Figure 4:
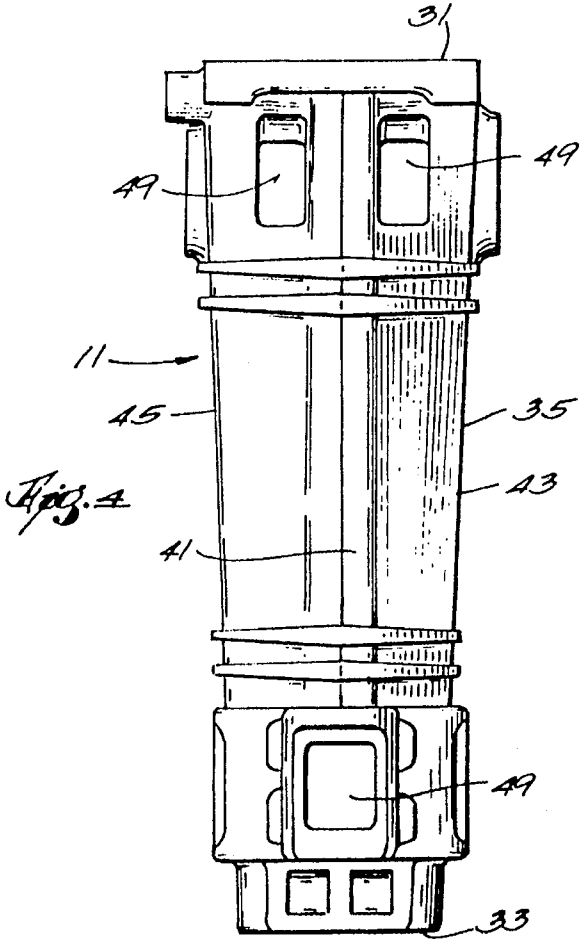
FIG. 4 is a front elevational view of the exhaust housing and pattern assembly shown in FIG. 1.
Figure 14:
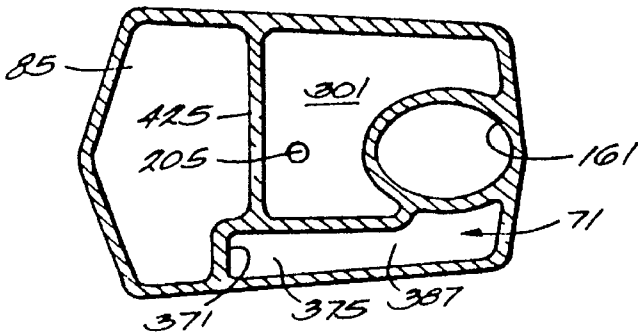
FIG. 14 is a sectional view taken along line 14—14 of FIG. 1.
Figure 16:
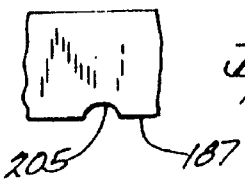
FIG. 16 is a fragmentary section view taken along line 16—16 of FIG. 10.
Figure 13:
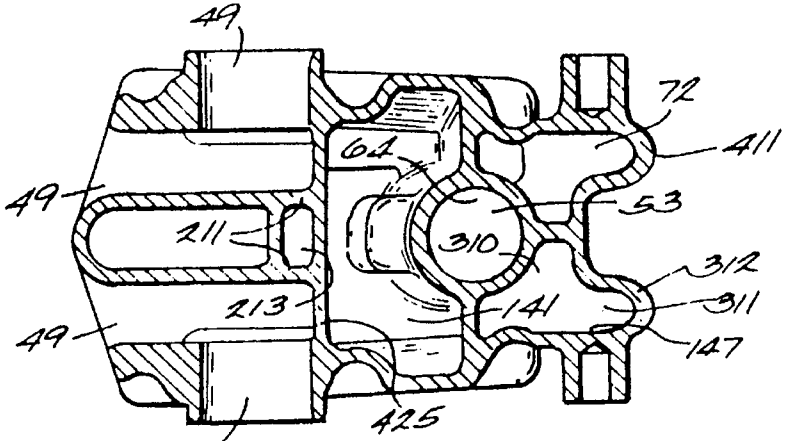
FIG. 13 is a sectional view taken along line 13—13 of FIG. 1.

It is noted that, except as described herein, the endless outer surface 35 of the exhaust housing or casting 11 and of the pattern assembly 13 is unbroken. It is also noted that both the pattern assembly 13 and the exhaust housing or casting 11 include, see FIGS. 6, 13, and 14, a generally centrally located and vertically extending barrier wall 425 separating the forwardly located cavity 85 from the exhaust gas passage 51, the idle relief expansion chambers 135 and 141, and the coolant discharge passage 61. This barrier wall 425 is formed by the walls 351 and 391 in the starboard outer side piece 27, together full-width walls 253 and 171 formed respectively in the starboard and port inner pieces 25 and 23, and the wall 105 formed in the port outer side piece 21. The inner wall 425 is closed except for the central portion 375 of the coolant supply passage 71 located between the walls 353 and 371 in the starboard outer side piece 27, which coolant supply passage portion 375 permits water flow from forwardly of the barrier wall 425 to rearwardly of the barrier wall 425.

In addition, and except for connection to the rearward walls or surfaces 153 and 233 of the port and starboard inner pieces 23 and 25, the lower portion of the megaphone passage portion 55 is almost completely surrounded by the space 301 which forms a part of the lower expansion chamber portion 57 of the exhaust gas passage.

After casting, the exhaust housing 11 is machined to provide, as shown in FIG. 3, an aperature 421 in the starboard side thereof to permit entry into the exhaust housing 11 of a portion (not shown) of a clutch actuating mechanism.

Various of the features of the invention are set forth in the following claims.

We claim:

1. A lost foam pattern assembly comprising a port outer piece including a port outer side surface, and an inner surface defining a mating face, a port inner piece including an outer surface defining a mating face in engagement with said mating face of said inner surface of said port outer piece, and an inner surface defining a mating face and partially defining an exhaust gas passage, a starboard inner piece including an inner surface including a mating face in engagement with said mating face of said inner surface of said port inner piece and partially defining said exhaust gas passage, and an outer surface including a mating face, and a starboard outer piece including an inner surface defining a mating face in engagement with said mating face of said outer surface of said starboard inner piece, and a starboard outer side surface.

2. An assembly in accordance with claim 1 wherein said inner surface of said port outer piece and said outer surface of said port inner piece define a coolant discharge passage.

3. An assembly in accordance with claim 1 wherein said inner surface of said starboard outer piece and said outer surface of said starboard inner piece define a coolant supply passage.

4. An assembly in accordance with claim 3 wherein said port and starboard inner and outer pieces define a barrier wall extending between said port and starboard outer surfaces, wherein said exhaust gas passage is located rearwardly of said barrier wall, and wherein said coolant supply passage includes an upper portion located rearwardly of said barrier wall, a lower portion located forwardly of said barrier wall, and a central portion passing through said barrier wall.

5. An assembly in accordance with claim 1 wherein said port and starboard inner and outer pieces also define an idle exhaust gas passage located rearwardly of said barrier wall and including a series of expansion chambers.

6. A lost foam pattern assembly having a front, and comprising a port outer piece including a port outer side surface, and an inner surface including a mating face and partially defining a forward cavity and a coolant discharge passage, a port inner piece including an outer surface including a mating face in engagement with said mating face of said inner surface of said port outer piece and partially defining said coolant discharge passage, an inner surface including a mating face and partially defining an exhaust passage, and a wall extending between said mating faces of said port inner piece and partially defining said forward cavity which is located forwardly of said exhaust passage, a starboard inner piece including an inner surface including a mating face in engagement with said mating face of said inner surface of said port inner piece and partially defining said exhaust gas passage and said cavity, an outer surface including a mating face and partially defining a coolant supply passage, and a wall extending between said mating faces of said starboard inner piece and partially defining said cavity, and a starboard outer piece including an inner surface including a mating face in engagement with said mating face of said outer surface of said starboard inner piece, and partially defining said coolant supply passage, and a starboard outer side surface.

* * * * *